US007851422B2

(12) United States Patent
Ichitani et al.

(10) Patent No.: US 7,851,422 B2
(45) Date of Patent: Dec. 14, 2010

(54) QUENCHING OIL FOR REDUCED PRESSURE QUENCHING AND METHOD FOR QUENCHING

(75) Inventors: Katsumi Ichitani, Ichihara (JP); Makoto Takeishi, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 412 days.

(21) Appl. No.: 10/591,705

(22) PCT Filed: Mar. 9, 2005

(86) PCT No.: PCT/JP2005/004053

§ 371 (c)(1),
(2), (4) Date: Jan. 19, 2007

(87) PCT Pub. No.: WO2005/087955

PCT Pub. Date: Sep. 22, 2005

(65) Prior Publication Data

US 2007/0191241 A1 Aug. 16, 2007

(30) Foreign Application Priority Data

Mar. 10, 2004 (JP) ..... 2004-068156

(51) Int. Cl.
*C10M 143/00* (2006.01)
*C21D 1/58* (2006.01)

(52) U.S. Cl. ..... 508/591; 208/18; 585/10; 585/12; 148/29; 148/637

(58) Field of Classification Search ..... 508/591; 585/10, 12; 148/637
See application file for complete search history.

(56) References Cited

U.S. PATENT DOCUMENTS

| | | | | |
|---|---|---|---|---|
| 4,090,891 | A * | 5/1978 | Mitamura et al. | 148/28 |
| 5,595,966 | A * | 1/1997 | Rees et al. | 508/591 |
| 6,239,082 | B1 * | 5/2001 | Hewson et al. | 508/287 |
| 6,723,188 | B2 * | 4/2004 | Shimosato et al. | 148/637 |
| 6,815,401 | B2 * | 11/2004 | Nakamura | 508/192 |
| 6,828,285 | B2 * | 12/2004 | Nakamura | 508/192 |
| 7,347,927 | B2 * | 3/2008 | Ichitani et al. | 208/14 |
| 7,358,217 | B2 * | 4/2008 | Sweet et al. | 508/585 |
| 7,503,985 | B2 * | 3/2009 | Ichitani et al. | 148/637 |
| 2002/0166610 | A1 * | 11/2002 | Shimosato et al. | 148/637 |
| 2003/0096714 | A1 * | 5/2003 | Nakamura | 508/192 |
| 2003/0136484 | A1 * | 7/2003 | Ichitani et al. | 148/713 |
| 2003/0144157 | A1 * | 7/2003 | Nakamura | 508/294 |
| 2003/0201205 | A1 | 10/2003 | Ichitani et al. | |
| 2005/0011597 | A1 * | 1/2005 | Sweet et al. | 148/713 |
| 2005/0039832 | A1 * | 2/2005 | Sweet et al. | 148/713 |

FOREIGN PATENT DOCUMENTS

| | | |
|---|---|---|
| CN | 1462314 A | 12/2003 |
| JP | 2001 192689 | 7/2001 |
| JP | 2001 316722 | 11/2001 |
| JP | 2002 327191 | 11/2002 |

OTHER PUBLICATIONS

"Research of High-efficiency Multi-purpose Quenching Oil, Yu Tianhong & Sun Liangui", Petroleum Products Application Research, vol. 3, 1996, 4 pages (English translation only).
K. Ichitani, "Influence of Cooling Process on Quenching Distortion", Heat Treatment, vol. 42, No. 5, pp. 341-345 (Oct. 28, 2002)(with English translation).
Office Action issued Jul. 27, 2010, in Japan Patent Application No. 2006-510951, filed Aug. 25, 2006.

* cited by examiner

*Primary Examiner*—Ellen M McAvoy
(74) *Attorney, Agent, or Firm*—Oblon, Spivak, McClelland, Maier & Neustadt, L.L.P.

(57) ABSTRACT

A quenching oil for reduced pressure quenching which comprises a base oil having a kinematic viscosity at 40° C. of 40 $mm^2/s$ or more and a vapor blanket breaking agent; and a method for quenching wherein the quenching oil is used and quenching is carried out while adjusting the pressure on the surface of the oil. The method allows the achievement of cooling characteristics over a wide range from those conventionally achieved by a cold oil to those by a hot oil, by the use of a single quenching oil.

14 Claims, No Drawings

QUENCHING OIL FOR REDUCED PRESSURE QUENCHING AND METHOD FOR QUENCHING

This application is a 371 of PCT/JP05/04053 filed Mar. 9, 2005.

TECHNICAL FIELD

The present invention relates to a quenching oil for reduced pressure quenching and a method for quenching, more particularly, relates to a quenching oil for reduced pressure quenching, wherein the quenching oil alone can quench a various kinds of metallic materials at optimum conditions, and a quenching method using the same.

BACKGROUND ART

A quenching oil is used for a quenching treatment performed in order to cool metallic materials such as steel quickly to harden them. Accordingly, the quenching oil is required to have high cooling characteristics.

However, generally, in a quenching treatment, when the cooling characteristics of the quenching oil are too high, quenching distortion or the like occurs. On the contrary, when the quenching distortion is suppressed, the cooling characteristics become insufficient, resulting in the lack of quenching hardness. Accordingly, it is difficult that the quenching hardness, the quenching distortion etc. are satisfied simultaneously. Therefore, there are two types of quenching oils, so called a cold oil and a hot oil (martempering oil).

Since the cold oil usually uses a low viscosity base oil, thereby has high cooling characteristics. However, since its vapor blanket stage is long, quenching unevenness tends to occur, thereby the quenching distortion is liable to occur. Therefore, in many cases, a vapor blanket breaking agent is blended to shorten the vapor blanket stage. On the contrary, since the hot oil usually uses a high viscosity base oil, it has a short vapor blanket stage and, thereby has low quenching distortion. However, since its boiling point and its convection stage starting temperature are high, its cooling characteristics are low. Accordingly, when importance is attached to the hardness of a quenched body, the cold oil is used, and when importance is attached to the suppression of the distortion of the quenched body, the hot oil is used. In other words, it is required to select and use quenching oils in accordance with the required quality, thereby, oil changing is forced in each quenching.

On the contrary, there is a proposal that the quenching distortion can be suppressed by making the vapor blanket stage longer and stable by means of a quenching treatment under a reduced pressure using a high viscosity quenching oil, and the cooling performance can be changed (for example, refer to Patent document 1).

However, since, when the vapor blanket stage is made longer by performing quenching under a reduced pressure, the cooling characteristics become insufficient, resulting in the lack of wide usuability such as decrease in the hardness of the quenched body, and possible development of phenomena of imperfect quenching depending on the quality of metallic materials. Accordingly, a quenching oil and a quenching method that alone can suppress the quenching distortion, according to metallic materials with various qualities and shapes, and provide proper cooling characteristics without changing a quenching oil through the wide adjustability of its cooling characteristics, are expected to appear.

Patent document 1: Japanese Patent Application Laid-Open No. Hei 07-54038

DISCLOSURE OF THE INVENTION

The present invention is performed from the above-mentioned view point, and provides a quenching oil that alone can exhibit a wide range of cooling characteristics from those of cold oil to those of hot oil. Moreover, the present invention provides a quenching method that exhibits a wide range of cooling characteristics from those of cold oil to those of hot oil by using a single quenching oil.

The inventors of the present invention found that, by using a quenching oil composed of a base oil having a kinematic viscosity of a certain value or more, blended with a vapor blanket breaking agent, and by adjusting the pressure on the surface of the oil under a reduced pressure during quenching, its cooling performance could be adjusted over a wide range. The present invention is completed based on such a finding.

In other words, the present invention provides:

[1] a quenching oil for reduced pressure quenching comprising (A) a base oil having a kinematic viscosity at 40° C. of 40 $mm^2/s$ or more, blended with (B) a vapor blanket breaking agent;

[2] the quenching oil for reduced pressure quenching described in the above [1], wherein the base oil has a characteristic time of 2.5 or less, in the test of heat treating oils in JIS K 2242;

[3] the quenching oil for reduced pressure quenching described in the above [1] or [2], wherein the kinematic viscosity at 40° C. of the base oil is 40 to 300 $mm^2/S$;

[4] the quenching oil for reduced pressure quenching described in the above [1], [2], or [3], wherein the blending amount of the vapor blanket breaking agent is 5% or more by mass based on the quenching oil;

[5] a quenching method for performing quenching while adjusting the pressure on the surface of the oil, by using the quenching oil described in the above [1], [2], [3], or [4]; and

[6] the quenching method described in the above [5], wherein the adjusting range of the pressure on the surface of the oil is from normal pressure to 13 kPa.

According to the quenching oils and quenching methods of the present invention, by adjusting the pressure on the surface of the oil, the cooling characteristics can be changed over a wide range, while keeping the length of the vapor blanket stage proper. Therefore, it is possible to subject various kinds of metallic materials to a quenching treatment by using a single quenching oil without changing oil.

BEST MODE FOR CARRYING OUT THE INVENTION

In the quenching oil of the present invention, a base oil that has a kinematic viscosity at 40° C. of 40 $mm^2/s$ or more, preferably 40 to 300 $mm^2$, is used as (A) the base oil.

Since, when the kinematic viscosity at 40° C. is less than 40 $mm^2/s$, the vapor blanket stage becomes longer, the cooling characteristics may decrease and quenching unevenness may also occur, resulting in a possible quenching distortion.

Moreover, the upper limit of the kinematic viscosity at 40° C. of the base oil to be used in the present invention is not particularly limited, however, it is preferable to be 300 $mm^2/s$ or less. When the kinematic viscosity is 300 $mm^2/s$ or less, the cooling characteristics can be adjusted over a wide range while keeping the length of the vapor blanket stage proper.

Moreover, the base oils to be used for the present invention has a characteristic time, in the test of heat treating oils in JIS K 2242, preferably of 2.5 or less, more preferably of 2.0 or less. The characteristic time is referred to as the time required for the vapor blanket to reach a temperature at which the vapor blanket collapses in the cooling performance test defined in JIS K 2242, and it quantifies a length of the vapor blanket stage. Since, when the characteristic time is 2.5 or less, the cooling characteristics is good, thereby enabling to suppress the occurrence of quenching distortion due to the occurrence of quenching unevenness.

Moreover, as for the base oil to be used in the invention, when it satisfies the above conditions, the object of the present invention can be achieved, however, typically, it has further the following properties.

It is preferable that the base oil to be used in the invention has a flash point of 230° C. or more, especially 250° C. or more. When the flash point is 230° C. or more, it is possible to suppress changing of the cooling characteristics with time due to the evaporation of the light component contained in the base oil, and good safety can also be attained.

Moreover, from the similar purpose for making the flash point high as mentioned above, it is preferable that the base oil to be used in the present invention has the light cut, whose boiling point is below 400° C., of 5% or less by mass.

Specifically, as for the base oils to be used in the present invention, mineral oils are used generally. As the mineral oils specifically used in the invention, there can be mentioned a distillated oil obtained by means of atmospheric distillation of a paraffinic crude oil, an intermediate crude oil, a naphthenic crude oil, an aromatic crude oil, or the like, or obtained by means of reduced-pressure distillation of the residual oil of the atmospheric distillation, refined oils obtained by refining these oils by the conventional methods, for example, a solvent-refined oil, a hydrogenation-refined oil, a hydrocracking-refined oil, a solvent dewaxing-refined or hydrogenation dewaxing-refined oil, clay-treated oil, and the like. Moreover, synthetic oils such as alkyl benzene, alkyl naphthalene, α-olefin oligomer (PAO), α-olefin copolymer, polybutene, dibasic acid ester, hindered ester, polyoxyalkylene glycol, polyoxyalkylene glycol ester, polyoxyalkylene glycol ether, a silicone oil and the like can also be used.

These base oils can be used alone or by mixing two kinds or more of them. However, when a low viscosity base oil and a high viscosity base oil are mixed, it is preferable to prevent the flash point from becoming lower, or to prevent the light cut below 400° C. from increasing, because there is a case that the flash point cannot be hold enough high or light cuts are present in a large amount, due to the presence of the low viscosity base oil.

In quenching oils of the present invention, (B) a vapor blanket breaking agent is blended to the above-mentioned (A) base oil. By blending the vapor blanket breaking agent to the above-mentioned base oil, the vapor blanket stage of the base oil is shortened under reduced pressure and the like, thereby, resulting in the effect to widen the adjustable range of the cooling characteristics.

The vapor blanket breaking agents are not particularly limited. Conventional vapor blanket breaking agents blended in a cold oil can be used. Specifically, there can be mentioned a high molecular polymer such as ethylene-α-olefin copolymer, polyolefin, poly-methacrylate, a high molecular weight polymeric organic compound such as asphaltum and the like, and an oil-dispersion type inorganic compound. One kind of these vapor blanket breaking agents may be used alone, or in the combination of two kinds or more of them.

The blending amount of the vapor blanket breaking agent is not particularly limited, and the blending amount of 1% or more by mass is effective, however, especially 5% or more by mass, and further 6% or more by mass, is significantly effective.

The upper limit of the blending amount of the vapor blanket breaking agent is not particularly limited, but it is preferable to be 30% or less by mass, especially, 20% or less by mass. When the blending amount of the vapor blanket breaking agent is 30% or less by mass, it is possible to suppress the change of properties such as the viscosity of the quenching oil.

The quenching oils of the present invention can be further blended with additives, if required, within a range which does not impaire the object of the invention. As such additives, for example, deteriorated acid neutralizers, antioxidants, brightness improvers and the like can be mentioned. As the deteriorated acid neutralizers, for example, salicylates, sulfinates, sulfonates, and the like of alkali earth metals can be mentioned. As the alkaline earth metals, calcium, magnesium, barium, and the like are preferable. Moreover, as the antioxidants, amine-based antioxidants, hindered phenol-based antioxidants, and the like can be mentioned. Further, as the brightness improvers, there can be mentioned fats and oils, fatty acids of fats and oils, alkenyl succimides, substituted hydroxyaromatic carboxylate ester derivatives, and the like.

Next, the quenching method of the present invention is a quenching method for performing quenching by using the above-mentioned quenching oils, while adjusting the pressure on the surface of the oil in a heat treating furnace. That is, it is a quenching method for performing quenching, using a sealed heat treating furnace such as a vacuum furnace or a vacuum carburizing furnace, by adjusting the cooling characteristics depending on the purpose of the quenching treatment by means of adjusting the pressure from normal pressure to reduced pressure on the surface of the oil of the quenching oil. In this case, it is preferable that the adjusting range of the pressure on the surface of the oil is from normal pressure (about 0.1 MPa) to 13 kPa. When the pressure on the surface of the oil is within the above-mentioned range, the effect of blending a vapor blanket breaking agent is excellent. By adjusting the pressure on the surface of the oil within the above-mentioned range, it is possible to adjust a quenching intensity (H-value), representing cooling characteristics, at least within a range of 0.10 to 0.14/cm, while maintaining the characteristic time to be 2.5 or less.

The above-mentioned quenching intensity is usually referred to as H-vale, which is a numeric value representing the cooling characteristics, and can be calculated from the time required for cooling from 800 to 300° C. in the cooling curve in the test of heat treating oils in JIS K 2242.

Moreover, since the range of the H-value of a usual cold oil is from 0.12 to 0.14, and the range of the H-value of a hot oil is from 0.10 to 0.12, according to the quenching method of the present invention, it is possible to cover the ranges of the H-values of the usual cold oil and hot oil.

Specifically, quenching should be performed by adjusting the pressure on the surface of the oil lower, for example, about 15 to 70 kPa, when the quenching oil is used as a cold oil, and higher, for example, about 80 to 101 kPa, when the quenching oil is used as a hot oil. In this manner, it is possible to use a single quenching oil as a cold oil and also as a hot oil without changing oil.

Further, the another aspect of the quenching method of the present invention includes a method for performing quenching by changing the pressure on the surface of the oil in the midway of the quenching treatment when one quenching component body is quenched.

As an example, there can be mentioned a quenching method in which the vapor blanket stage is carried out under a reduced pressure, and then the pressure is increased to a normal pressure or to a near normal pressure rapidly. According to the method, it is possible to enter a boiling stage faster, thereby, enabling to enhance the cooling characteristics while suppressing the quenching distortion. Moreover, inversely, there can be mentioned a quenching method of starting quenching under a normal pressure or under a near normal pressure, and reducing the pressure rapidly simultaneously with the vapor blanket breaking. According to this method, an effect for widening the boiling stage without prolonging the vapor blanket stage can be achieved.

Moreover, in the quenching method of the present invention, quenching is performed by adjusting the pressure on the surface of the oil, however, at the same time, such a method as changing the oil temperature, or as changing the stirring flow rate and the like, can also be employed. Consequently, there is a possibility that the adjusting range of the cooling characteristics (H-value) can be further widened.

EXAMPLES

Next, using examples and comparative examples, the present invention will be explained further in detail, however, the present invention is not limited to these examples. Here, performances such as the cooling characteristics are obtained by the following methods.

(1) Testing Method for Cooling Performance

The testing method for cooling performance defined in JIS K 2242 was performed by using a testing apparatus provided with a vacuum chamber in order to adjust the pressure on the surface of the oil, and cooling curves under various pressures were measured to obtain a characteristic time and a H-value under each pressure.

(2) Characteristic Time

The time required to reach a characteristic temperature was measured from the above-mentioned cooling curves as characteristic time.

(3) H-value

Using the time required to reach from 800 to 300° C. in the cooling curves, the H-values were obtained based on Osaka University's cooling power evaluation method.

Example 1

Using a quenching oil which was composed of a base material having a kinematic viscosity at 40° C. of 90 $mm^2/s$, a characteristic time of 2.3, a flash point of 265° C., and a 2% by mass light fraction below 400° C., and was blended with a vapor blanket breaking agent of asphaltum, which was a residue of petroleum refining and had a kinematic viscosity at 100° C. of 500 $mm^2/s$ which was available from NIHON CHEMICALS HANBAI KABUSHIKI KAISHA, at 12% by mass based on the quenching oil, cooling curves were measured at respective pressures of normal pressure (101 kPa), 66.7 kPa, 40.0 kPa, and 13.3 kPa to obtain the characteristic times and the H-values. The results are shown in Table 1.

TABLE 1

| pressure on the surface of the oil (kPa) | characteristic time (s) | H-value (/cm) |
|---|---|---|
| 101 | 1.0 | 0.10 |
| 66.7 | 1.2 | 0.11 |
| 40.0 | 2.0 | 0.14 |
| 13.3 | 3.3 | 0.14 |

As realized from Table 1, in the quenching oil of the invention, by changing the pressure on the surface of the oil from normal pressure to 40.0 kPa, the H-value can be adjusted from 0.10 to 0.14 at a characteristic time of 2.0 or less.

Example 2

Using a quenching oil which was composed of a base material having a kinematic viscosity at 40° C. of 100 $mm^2/s$, a characteristic time of 2.2, a flash point of 270° C., and a 0% by mass light fraction below 400° C., and was blended with a vapor blanket breaking agent of polybutene, which had a number average molecular weight of 2000 and was available from Idemitu Kosan Co., Ltd., at 7% by mass based on the quenching oil, cooling curves were measured at respective pressures of normal pressure (101 kPa), 40.0 kPa, and 13.3 kPa to obtain the characteristic times and the H-values. The results are shown in Table 2.

TABLE 2

| pressure on the surface of the oil (kPa) | characteristic time (s) | H-value (/cm) |
|---|---|---|
| 101 | 1.0 | 0.11 |
| 40.0 | 2.3 | 0.14 |
| 13.3 | 5.0 | 0.12 |

As realized from Table 2, in the quenching oil of the invention, by changing the pressure on the surface of the oil from normal pressure to 40.0 kPa, the H-value can be adjusted from 0.11 to 0.14 at a characteristic time of 2.3 or less.

Example 3

Using a quenching oil which was composed of a base material having a kinematic viscosity at 40° C. of 400 $mm^2/s$, a characteristic time of 1.0, a flash point of 300° C., and a 0% by mass light fraction below 400° C., and was blended with a vapor blanket breaking agent (asphaltum used in Example 1) at 5% by mass based on the quenching oil, the H-values and the characteristic times were obtained similarly to Example 2. The results are shown in Table 3.

TABLE 3

| pressure on the surface of the oil (pKa) | characteristic time (s) | H-value (/cm) |
|---|---|---|
| 101 | 0.7 | 0.09 |
| 40.0 | 1.8 | 0.13 |
| 13.3 | 3.0 | 0.12 |

As realized from Table 3, in the quenching oil of the invention, by changing the pressure on the surface of the oil from normal pressure to 13.3 kPa, the H-value can be adjusted from 0.09 to 0.14 at a characteristic time of 2.5 or less.

Comparative Example 1

Using a quenching oil which was composed of a base material having a kinematic viscosity at 40° C. of 30 $mm^2/s$, a characteristic time of 3.4, a flash point of 220° C., and a 15% by mass light fraction below 400° C., and was blended with a vapor blanket breaking agent of asphaltum (the same as used in Example 1) at 15% by mass based on the quenching oil, the H-values and the characteristic times were obtained similarly to Example 2. The results are shown in Table 4.

TABLE 4

| pressure on the surface of the oil (kPa) | characteristic time (s) | H-value (/cm) |
|---|---|---|
| 101 | 1.5 | 0.12 |
| 40.0 | 3.0 | 0.14 |
| 13.3 | 5.0 | 0.13 |

As realized from Table 4, in the quenching oil with a kinematic viscosity at 40° C. of 30 $mm^2/s$, even when the pressure on the surface of the oil is changed from normal pressure to 13.3 kPa, the H-values which can be adjusted remain near 0.12 at a characteristic time of 2.5 or less.

Comparative Example 2

Using a quenching oil which was composed of a base material having a kinematic viscosity at 40° C. of 12 $mm^2/s$, a characteristic time of 6.0, a flash point of 170° C., and a 80% by mass light fraction below 400° C., and was blended with a vapor blanket breaking agent of asphaltum (the same as used in Example 1) at 15% by mass based on the quenching oil, the H-values and the characteristic times were obtained similarly to Example 2. The results are shown in Table 5.

TABLE 5

| pressure on the surface of the oil (kPa) | characteristic time (s) | H-value (/cm) |
|---|---|---|
| 101 | 2.2 | 0.14 |
| 40.0 | 3.0 | 0.15 |
| 13.3 | 9.0 | 0.13 |

As realized from Table 5, in the quenching oil using the base oil having a kinematic viscosity at 40° C. of 12 $mm^2/s$, even when the pressure on the surface of the oil is changed from normal pressure to 13.3 kPa, the H-values which can be adjusted remain near 0.14 at a characteristic time of 2.5 or less.

Comparative Example 3

Using a quenching oil which was composed of a base material having a kinematic viscosity at 40° C. of 200 $mm^2/s$, a characteristic time of 1.1, a flash point of 280° C., and a 2% by mass light fraction below 400° C., and was not blended with a vapor blanket breaking agent, the H-values and the characteristic times were obtained similarly to Example 2. The results are shown in Table 6.

TABLE 6

| pressure on the surface of the oil (kPa) | characteristic time (s) | H-value (/cm) |
|---|---|---|
| 101 | 1.1 | 0.08 |
| 40.0 | 1.6 | 0.10 |
| 13.3 | 2.8 | 0.11 |

As realized from Table 6, in the quenching oil which is not blended with a vapor blanket breaking agent, when the pressure on the surface of the oil is changed from normal pressure to 13.3 kPa, the H-value is 0.11 or less, and cannot be adjusted to be higher than that.

INDUSTRIAL APPLICABILITY

According to the quenching oil and the quenching method of the invention, since the cooling characteristics can be changed over a wide range, while maintaining the characteristic time at a proper value by adjusting the pressure on the surface of the oil during quenching, they can be utilized as a quenching oil and a quenching method that can quench various kinds of metallic materials optimally by using a single oil.

The invention claimed is:

1. A method for quenching a metallic material, comprising:

adjusting the pressure on the surface of a quenching oil to 13-70 kPa;

wherein the quenching oil consists of:

(A) a base oil having a kinematic viscosity at 40° C. of 40 $mm^2/s$ or more; and (B) a vapor blanket breaking agent, the vapor blanket breaking agent being present in an amount of from 1 to 30% by mass based on a total mass of the quenching oil.

2. The method according to claim 1, wherein the base oil has a characteristic time of 2.5 or less, in the test of heat treating oils in JIS K 2242.

3. The method according to claim 1, wherein the kinematic viscosity at 40° C. of said the base oil is from 40 to 300 $mm^2/s$.

4. The method according to claim 1, wherein the quenching oil comprises the vapor blanket breaking agent in an amount of 5 to 30% by mass based on the total mass of the quenching oil.

5. The method according to claim 1, wherein the pressure on the surface of the quenching oil is adjusted to 15-70 kPa.

6. The method according to claim 1, wherein:

the base oil has a characteristic time of 2.5 or less, in the test of heat treating oils in JIS K 2242;

the kinematic viscosity at 40° C. of the base oil is 40 to 300 $mm^2/s$; and the pressure on the surface of the quenching oil is adjusted to 15-70 kPa.

7. The method according to claim 1, wherein the base oil has a characteristic time of 2.0 or less, in the test of heat treating oils in JIS K 2242.

8. The method according to claim 1, wherein the base oil has a flash point of 230° C. or more.

9. The method according to claim 1, wherein the base oil comprises 5% or less by mass of a light cut having a boiling point of less than 400° C.

10. The method according to claim 1, wherein the base oil comprises mineral oil.

11. The method according to claim 1, wherein metallic material is steel.

12. The method according to claim 1, wherein quenching is performed in a vacuum furnace.

13. The method according to claim 1, wherein quenching is performed in a vacuum carburizing furnace.

14. The method according to claim 1, further comprising contacting the metallic material with the quenching oil when the pressure on the surface of the quenching oil is 13-70 kPa.

* * * * *